US005930966A

United States Patent [19]

Wood et al.

[11] Patent Number: 5,930,966

[45] Date of Patent: Aug. 3, 1999

[54] SCREW PIERCABLE STRUCTURAL SUPPORT FOR A PLANAR SUBSTRATE

[75] Inventors: Charles Francis Wood, Mississauga; Clarence Pangsum Au, Thornhill, both of Canada

[73] Assignee: Aluma Enterprises Inc.

[21] Appl. No.: 08/951,562

[22] Filed: Oct. 16, 1997

[51] Int. Cl.[6] ..... E04C 3/04; E04G 11/50

[52] U.S. Cl. ..... 52/364; 52/650.1; 52/630; 52/729.1; 52/731.1; 52/733.2; 52/731.7; 249/23; 249/189; 249/211

[58] Field of Search ..... 52/650.1, 650.3, 52/376, 364, 365, 729.1, 729.4, 729.2, 731.1, 737.3, 801.1, 801.11, 344, 356, 363, 377, 647, 733.2, 731.7, 630; 249/18, 23, 24, 25, 189, 211; 29/897.3, 897.31, 897.312, 897.35

[56] References Cited

U.S. PATENT DOCUMENTS

| | | | |
|---|---|---|---|
| 1,204,955 | 11/1916 | Day | 52/364 |
| 3,243,930 | 4/1966 | Slowinski | 52/364 |
| 3,381,433 | 5/1968 | Davis, Jr. | 52/364 |
| 4,070,845 | 1/1978 | Cody | 52/632 |
| 4,156,999 | 6/1979 | Avery | 52/376 |
| 4,159,604 | 7/1979 | Burrell | 52/376 |
| 4,333,289 | 6/1982 | Strickland | 52/376 X |
| 4,584,809 | 4/1986 | Stanford | 52/376 X |
| 5,205,087 | 4/1993 | Jines | 52/800.11 X |
| 5,233,807 | 8/1993 | Spera | 52/731.1 X |

FOREIGN PATENT DOCUMENTS

| | | | |
|---|---|---|---|
| 1293129 | 4/1962 | France | 52/481.1 |

*Primary Examiner*—Carl D. Friedman
*Assistant Examiner*—Laura A. Callo

[57] ABSTRACT

A structural support for supporting a planar substrate, for example plywood, is provided with a screw receiving channel. The channel provides a guide simplifying screw attachment for a substrate to the support.

10 Claims, 2 Drawing Sheets

FIG. 1.
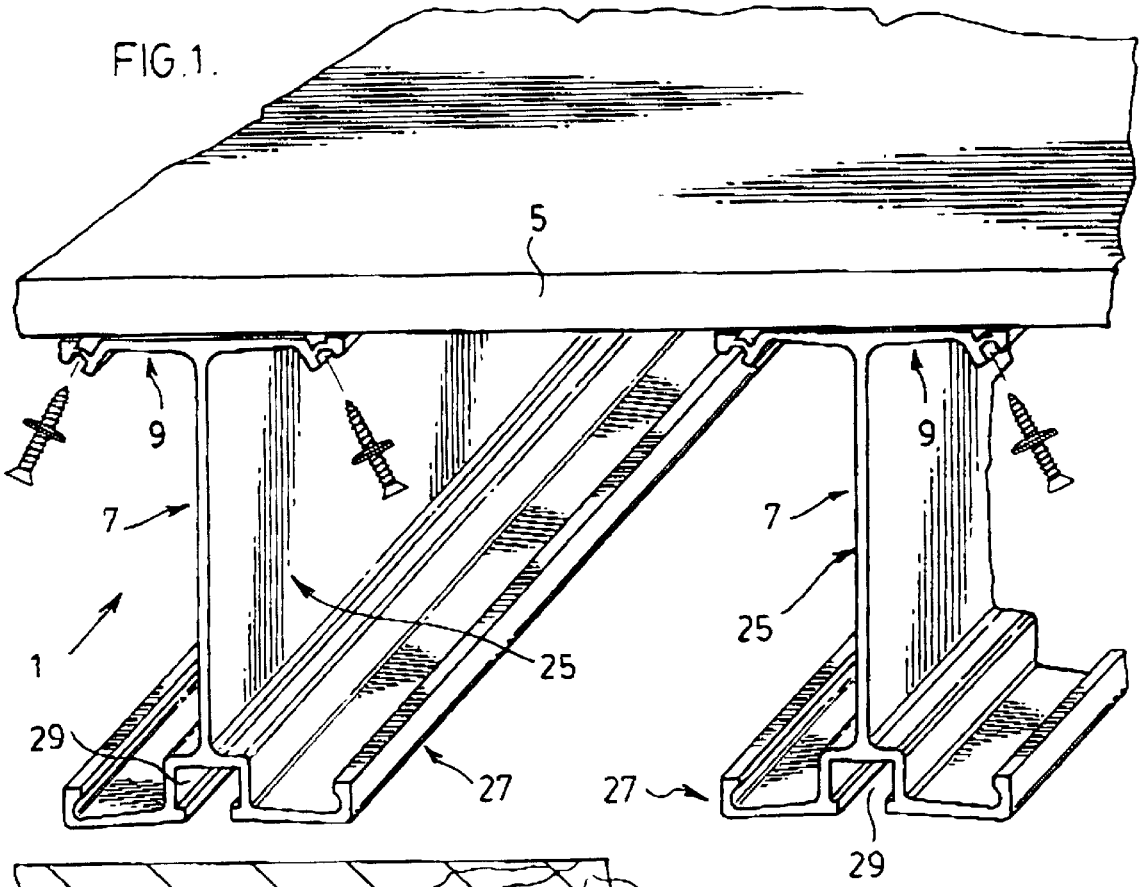
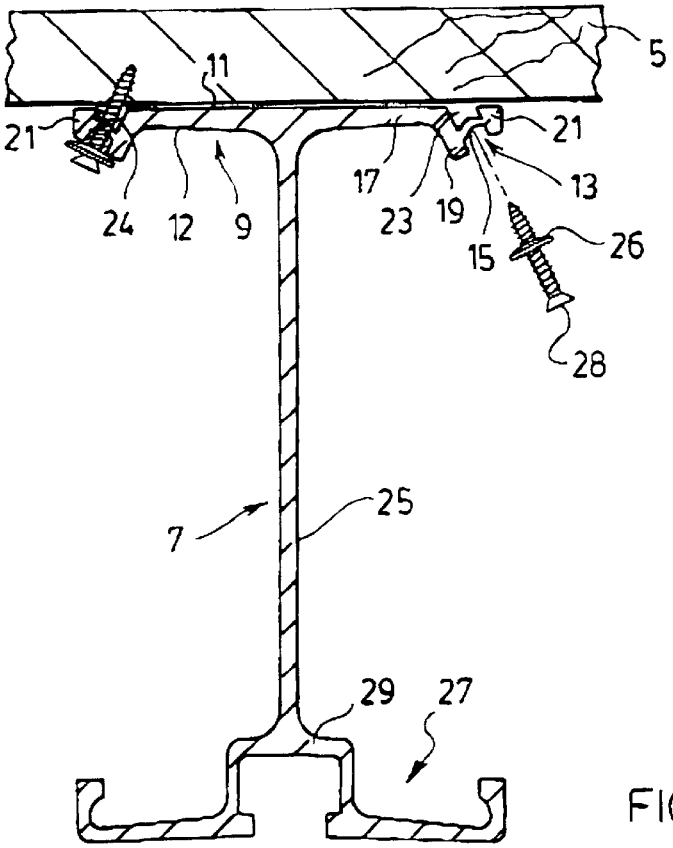
FIG. 2.

SCREW PIERCABLE STRUCTURAL SUPPORT FOR A PLANAR SUBSTRATE

FIELD OF THE INVENTION

The present invention relates to a structural support designed to secure and support a substrate used to form a wall or floor in a concrete forming system.

BACKGROUND OF THE INVENTION

It is standard practice in concrete forming to secure a substrate by means of a plurality of spaced apart fixed beams. These beams preferably are of an extruded aluminum or an aluminum composite.

Each beam has a planar support for engaging the rear face of the substrate. The substrate sits on one side of the support and screws are passed from the other side at 90° through the support into the substrate.

According to conventional practice, beams have a series of punched holes spaced along the length of the beam. The series of holes are provided as a second manufacturing step before the beams are sent to a construction site. It is also known to drill the beam as required on the construction site although this is not efficient.

The present invention addresses these problems and allows the use of a metal piercing screw thereby avoiding a drilling or punching step. Also the beam of the present invention can be manufactured at less cost and has an improved delivery cycle that can be critical in the construction industry. Self-drilling screws for metal are known which can be used with conventional beams to avoid the drilling or punching steps. Unfortunately, self-drilling screws have poor holding properties in the substrate. This is very important as this property determines the durability of the assembled beam and substrate.

SUMMARY OF THE INVENTION

The present invention provides a structural support for a planar substrate which has been particularly adapted to overcome the drawbacks noted above with respect to prior art beams. More particularly, the structural support for a planar substrate of the present invention has a platform one side of which is a substrate receiving face and the other side of which is a screw mounting side provided with a screw channel near an edge of the platform. The screw channel produces a thinning of the platform and acts as a guide for the securing screws. The thinned platform allows a metal piercing screw to be used, which screw has good holding properties with the substrate For example, a wood screw can pierce the thinned platform and provide a strong hold with the substrate.

According to an aspect of the invention, the screw channel is angled to a position in which it is readily accessible without interference from the base of the support and such that the securing screw has on increased ability to hold the substrate.

BRIEF DESCRIPTION OF THE DRAWINGS

Preferred embodiments of the invention are shown in the drawings, wherein:

FIG. 1 is a perspective view of a section of a planar substrate securing system according to a preferred embodiment of the present invention;

FIG. 2 is an end view showing one of the structural support members from the system of FIG. 1;

DETAILED DESCRIPTION OF THE PREFERRED EMBODIMENTS

Figure 3:
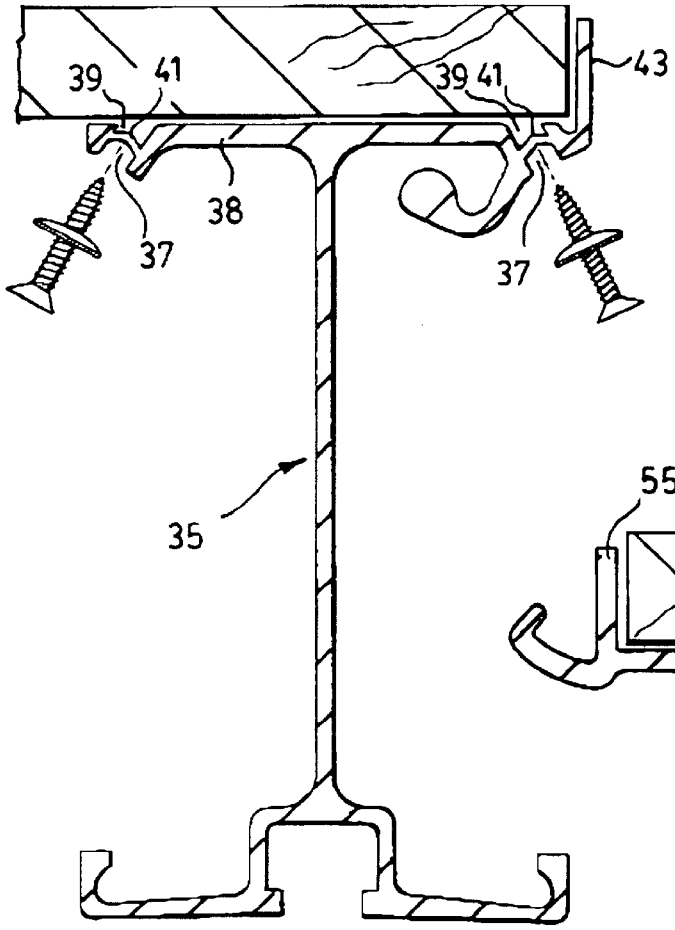
FIGS. 3 and 4 are end views of different structural supports according to further preferred embodiments of the present invention.

FIG. 1 shows a structural support system generally indicated at 1 for supporting a planar substrate 5. This system can be used in a horizontal position as shown in FIG. 1 where the substrate is intended to temporarily support a poured concrete floor or it can be used in a vertical position to provide temporary support for a poured concrete wall.

The system relies on a plurality of structural supports generally indicated at 7 having the substrate attached to one side of the supports.

In the preferred embodiment shown in FIGS. 1 and 2, each of the structural supports 7 has an I-beam construction or a channel-like construction. This construction includes a platform generally indicated at 9 at one side of the beam and a base generally indicated at 27 at the other side of the beam. The platform and the base are secured to one another by means of a main support web 25 at right angles to both the platform and the base.

The base, as is known in the art, has an undercut channel or bolt slot 29 for receiving a bolt head used to attach the base to the fixed support not shown.

The key to the present invention resides in features provided at the platform 9 of the structural support. In particular, the one side 11 of the platform receives and supports the substrate 5 and the other side 12, i.e. the side to which the web 25 is secured, is a screw mounting side of the platform. Side 12 is provided with a screw guide channel 13 near each edge of the platform. The substrate receiving face 11 of the platform is also provided with a pair of channels 23 opposed to and separated from the channels 13 by means of relatively thin piercable webs 15 in the platform. The webs divide the platform into a main platform region or central substrate support section 17 on one side of each web and an edge region 21 to the outside of each web. As will be clearly seen in FIG. 2, the edge region 21 is a peripheral rail which is substantially more robust than the web and provides reinforcement edgewise of the platform for the web 15. Any impact on the edge region which might otherwise damage the web is distributed by the edge region and avoids localized damage of the web. Although two screw receiving channels are shown, the support can be manufactured with a single channel, or three or more channels.

In the preferred embodiment as shown, structural support 7 is extruded aluminum and substrate 5 is in the form of a piece of plywood supported as shown in FIG. 1 by a plurality of spaced apart structural supports. The securing of the substrate to the platform 9 of the structural support is provided by a series of screws such as wood screw 28 that pierces through the aluminum into the substrate. Washers 26 may be provided on the wood screws 28.

As is clearly shown in FIG. 2, screws 28 are fitted into the screw channels 13 where they pierce the webs 15 which are substantially thinner than the rest of the platform. This allows for a much easier piercing of the platform. In addition, the webs 15 are V-shaped coming to an apex to form an acute angled section for seating the tip of the screw and further easing passage of the screw through the web at the desired 45° angle.

As will be seen in the left hand side of FIG. 2, the screw produces burrs 24 in the aluminum where it passes through the web 15. However, these burrs do not protrude above the flat substrate receiving face of the platform but rather are maintained in the channels 23. Furthermore, any burring which occurs on the screw mounting side of the platform occurs within the channels 13 so that a used support beam made in accordance with the present invention is much safer to handle than a used prior art beam where burring of the aluminum material occurs on an exposed surface where the beam might well be handled.

Another novel feature of the present invention is found in the orientation or angling of the screw channels. As will be seen, the main region 17 of the platform has an end portion 19 which is a stub flange on one side of channel 13. This end portion is set at an angle and preferably a 45° angle relative to the main region of the platform. The other side of the channel is bordered by the robust peripheral rail edge region 21 which is also angled at the mouth of the channel. The screw channel is therefore angled outwardly away from the main web of the beam at 45° to the platform. This angle allows good access for a power tool used to secure the screws. The peripheral rail 21 and the associated stub flange 19 provide bearing surfaces for contact with the fasteners.

The angling of the two channels as described immediately above, produces a number of benefits. Firstly, it provides a very good working tool angle at each channel. For example, when working with a power screw driver for passing the screw through the beam platform, there is no interference with the base or web of the beam. In addition, the angling away from 90° allows greater screw penetration into and more positive securing of the substrate to the support platform.

Although the description above has been specific with respect to the use of plywood as the substrate and wood piercing screws as the fasteners it would be understood that other appropriate substrates and screws could be used. For example, the substrate could be in the form of a plastic substrate held by appropriate screws or fasteners.

FIG. 3 shows a modified structural support generally indicated at 35. This support, like support 7, has a platform 38 with angled screw channels 37 to one side of the platform and separated from burr channels 39 on the other side of the platform by V-shaped webs 41. However, in this case, support 35 is additionally provided at one of its reinforced edges with a substrate edge guide 43 extending outwardly at 90° to the substrate receiving face of the platform. As will be understood, this particular structural support is only used along an edge of the substrate to protect the edge, whereas the structural supports 7 would be used away of the edges of the substrate.

Figure 4:
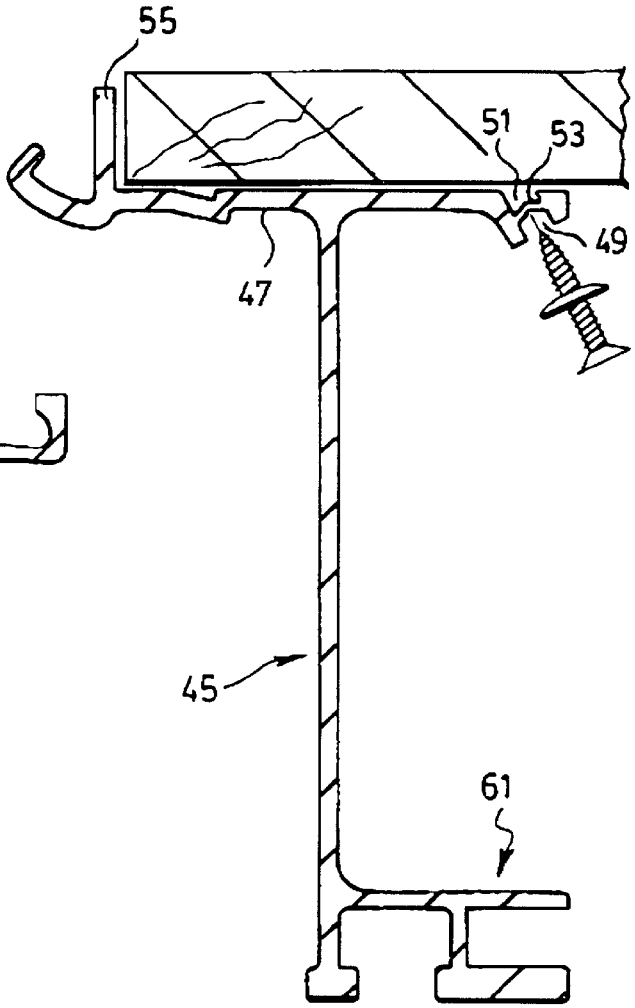

FIG. 4 shows a further modified structural support generally indicated at 45. This structural support has a platform 47, one edge of which is provided with opposing screw and burr channels 49 and 51 respectively separated by a V-shaped web 53. The other side of the platform is void of any screw and burr channels but is rather provided with a substrate edge guide 55.

The structural support configuration shown in FIG. 4 clearly demonstrates that the securing of the substrate need occur at one side only of the platform of the support. It also demonstrates that the support can be provided with a different type of base such as support base 61 used to secure the support to a different type of support member.

Although various preferred embodiments of the present invention have been described in detail, it will be appreciated by those skilled in the art, that variations may be made without departing from the spirit of the invention or the scope of the appended claims.

The embodiments of the invention in which an exclusive property or privilege is claimed are defined as follows:

1. An extruded aluminum alloy beam for supporting a wood substrate to one side thereof, said beam defining an I-beam type cross section, said cross section including a downwardly opening bolt slot in a lower flange of said beam centered relative to a web member with said web member joining said lower flange and a top flange, said top flange including a large central substrate support section bound on either side thereof by peripheral rail and a piercable web, each piercable web being recessed relative to both sides of said top flange a sufficient depth for receiving a secured burr within the recess, each peripheral rail cooperating with an associated downwardly and outwardly extending stub flange to define a downwardly and outwardly angled screw guide channel, each peripheral rail and the associated stub flange providing on the lower side of said top flange, bearing surfaces for contact with a fastener.

2. An extruded aluminum alloy beam as claimed in claim 1 wherein each piercable web is of an acute angled section which acts as a guide for centering a screw tip in an apex of said acute angled section.

3. An extruded aluminum alloy beam as claimed in claim 2 wherein said recesses either side of each piercable web are of similar depths.

4. An extruded aluminum alloy beam as claimed in claim 2 wherein said beam in section is symmetrical about said web.

5. An extruded aluminum alloy beam as claimed in claim 1 wherein each peripheral rail is of a maximum thickness greater than the thickness of said top flange.

6. A support arrangement comprising a sheet substrate supported on a lower surface thereof by a series of extruded beams having a general I beam type cross section; each beam comprising a downwardly opening bolt slot in a lower flange of said beam centered relative to a web member, said web member joining said lower flange and a top flange, said top flange including a major central substrate support section bound on either side of said web by a peripheral rail attached to said substrate support section by a piercable web, each piercable web being recessed on both sides of said top flange, each peripheral rail cooperating with an associated downwardly and outwardly extending stub flange to define a downwardly and outwardly angled screw guide channel, each peripheral rail and the associated stub flange providing bearing surfaces for contact with a fastener, said sheet substrate overlying said top flange and secured thereto by a host of fasteners extending at an angle through said piercable webs and embedded in said substrate below a top surface of said substrate.

7. A support arrangement as claimed in claim 6 wherein each piercable web is of an acute angled section which acts as a guide for centering a screw tip in an apex of said acute angled section.

8. A support arrangement as claimed in claim 7 wherein said recesses either side of each piercable web are of similar depths.

9. A support arrangement as claimed in claim 8 wherein said beam in section is symmetrical about said web.

10. A support arrangement as claimed in claim 6 wherein each peripheral rail is of a maximum thickness greater than the thickness of said top flange.

* * * * *